US009654866B2

(12) United States Patent
Kannan et al.

(10) Patent No.: US 9,654,866 B2
(45) Date of Patent: May 16, 2017

(54) SYSTEM AND METHOD FOR DYNAMIC RANGE COMPENSATION OF DISTORTION

(71) Applicant: Conexant Systems, Inc., Newport Beach, CA (US)

(72) Inventors: Govind Kannan, Irvine, CA (US); Harry K. Lau, Norwalk, CA (US); Trausti Thormundsson, Irvine, CA (US); Ragnar H. Jonsson, Laguna Niguel, CA (US)

(73) Assignee: Conexant Systems, Inc., Irvine, CA (US)

( * ) Notice: Subject to any disclaimer, the term of this patent is extended or adjusted under 35 U.S.C. 154(b) by 224 days.

(21) Appl. No.: 13/752,058

(22) Filed: Jan. 28, 2013

(65) Prior Publication Data

US 2013/0195277 A1 Aug. 1, 2013

Related U.S. Application Data

(60) Provisional application No. 61/591,775, filed on Jan. 27, 2012.

(51) Int. Cl.

| | |
|---|---|
| ***H04R 29/00*** | (2006.01) |
| ***H04R 1/32*** | (2006.01) |
| ***H04R 3/04*** | (2006.01) |

(52) U.S. Cl.

CPC ..... *H04R 1/32* (2013.01); *H04R 3/04* (2013.01); *H04R 29/001* (2013.01); *H04R 2430/03* (2013.01)

(58) Field of Classification Search

CPC ..... H04R 1/32; H04R 3/04; H04R 29/001; H04R 2430/03

See application file for complete search history.

(56) References Cited

U.S. PATENT DOCUMENTS

| | | | | |
|---|---|---|---|---|
| 4,495,640 | A * | 1/1985 | Frey | 381/61 |
| 5,465,413 | A | 11/1995 | Enge et al. | |
| 7,558,349 | B2 | 7/2009 | Kite | |
| 2007/0121097 | A1 | 5/2007 | Boillot | |
| 2009/0306490 | A1 | 12/2009 | Jacobs et al. | |
| 2010/0228368 | A1* | 9/2010 | Oh et al. | 700/94 |
| 2012/0230506 | A1* | 9/2012 | Pan et al. | 381/71.11 |
| 2015/0030181 | A1* | 1/2015 | Kimura et al. | 381/94.3 |
| 2015/0270819 | A1* | 9/2015 | Seefeldt | H03G 9/005 700/94 |

* cited by examiner

*Primary Examiner* — Andrew L Sniezek
(74) *Attorney, Agent, or Firm* — Haynes and Boone, LLP

(57) ABSTRACT

A system for controlling distortion comprising a total harmonic distortion (THD) modeling system configured to apply a chirp signal to a system and to identify one or more frequency bands at which distortion is present, and to apply a ramping signal to identify for each of the one or more frequency bands an input signal level at which distortion is initiated. A signal processing system configured to receive an input signal, to determine whether frequency components are present in the input signal that are associated with the one or more frequency bands at which distortion is present, and to limit the amplitude of the input signal at the one or more frequency bands, such as by applying dynamic range compensation.

18 Claims, 3 Drawing Sheets

SYSTEM AND METHOD FOR DYNAMIC RANGE COMPENSATION OF DISTORTION

RELATED APPLICATIONS

This application claims benefit of U.S. Provisional Application No. 61/591,775 filed Jan. 27, 2012, entitled "SYSTEM AND METHOD FOR DYNAMIC RANGE COMPENSATION OF DISTORTION," which is hereby incorporated by reference for all purposes.

TECHNICAL FIELD

The present disclosure relates generally to audio systems, and more specifically to systems and methods for preventing distortion from occurring in audio systems.

BACKGROUND OF THE INVENTION

Audio systems include many different components, such as speakers, amplifiers and structural components. Despite efforts to design each of these different components to avoid distortion, distortion is still present.

SUMMARY OF THE INVENTION

A system for controlling distortion comprising a total harmonic distortion (THD) modeling system configured to apply a chirp signal to a system and to identify one or more frequency bands at which distortion is present, and to apply a ramping signal to identify for each of the one or more frequency bands, an input signal level at which distortion is initiated. A signal processing system configured to receive an input signal, to determine whether frequency components are present in the input signal that are associated with the one or more frequency bands at which distortion is present, and to limit the amplitude of the input signal at the one or more frequency bands, such as by applying dynamic range compensation.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
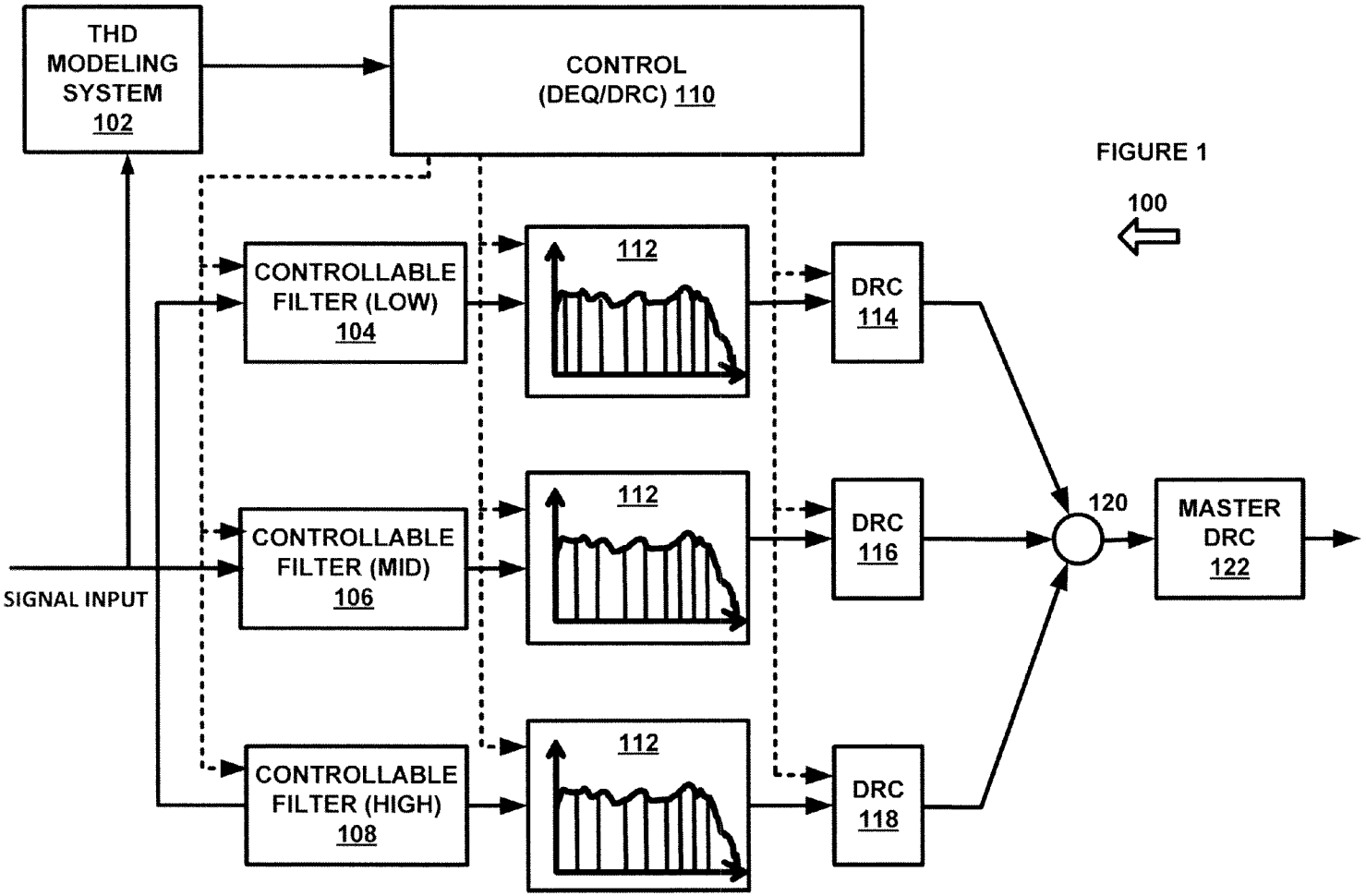
FIG. 1 is a diagram of a system for dynamic range compensation of distortion in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Loudspeakers are an integral part of a wide variety of modern consumer electronics products. Providing a clean distortion-free sound from the loudspeakers is difficult, as it requires coordinated acoustic design of each component in the audio system, such as power amplifiers, D/A converters, loudspeakers and enclosures. This coordinated design can be expensive, as it potentially requires a separate design for each application and a joint optimization across the different applications for best performance.

Distortion can be generalized into two categories: 1) hard distortion, such rub and buzz distortion, structural rattling, and electrical saturation that arise due to mechanical or electrical saturation, and 2) soft distortion, which is caused by inherent non-linearities in the electrical and mechanical properties of the audio system. The distortion can be measured by driving the system with tonal sweeps of various amplitudes and measuring the resultant total harmonic distortion (THD). Because distortion is reflected in THD curves, the distortion control problem is equivalent to a THD control problem, such that the distortion profile can be quantified by a series of equal-THD curves. As such, from an algorithmic and system design/testing perspective, playback distortion (hard and soft distortion) is a THD control problem, where modification of the signal can be used to reduce the THD below a specified level.

Signal modification can be achieved through dynamic band limiters that are controlled based on the equal-THD curves and the specified target distortion level. The specified level can depend on the target platform. For example, the specified level can be 10% for laptops, 15% for cell-phones, 5% for iPod docks and <1% for high fidelity consumer electronics. It should be noted that in this paradigm, the distinction between the different sources of distortion is no longer relevant. Regardless of whether the distortion is from a hard or soft distortion source, the distortion can be reduced with a look-ahead dynamic range compensation.

FIG. 1 is a diagram of a system 100 for dynamic range compensation of distortion in accordance with an exemplary embodiment of the present disclosure. System 100 can be implemented in hardware or a suitable combination of hardware and software. As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

System 100 includes THD modeling system 102, which is configured to apply a chirp signal or other suitable signals, to analyze the signal to identify frequency bands where distortion occurs, and to provide control data to other components of system 100 to subsequently process audio signals to prevent distortion. In one exemplary embodiment, THD modeling system can receive an input signal and provide control data to control (DEQ/DRC) 110, which provides control data to controllable filter (low) 104, controllable filter (mid) 106 and controllable filter (high) 108, such as to control the individual frequencies or frequency bands that correlate to frequencies or frequency bands where distortion has been identified. While controllable filter (low) 104, controllable filter (mid) 106 and controllable filter (high) 108 are shown as filtering the input signal into low, middle and high range signals, respectively, individual frequencies, individual frequency bands, combinations of frequencies or frequency bands, or other suitable frequency control can also or alternatively be provided.

Dynamic equalizers (DEQ) 112 are used to process the one or more frequencies or frequency bands, such as the low, middle and high range signals generated by controllable filter (low) 104, controllable filter (mid) 106 and controllable filter (high) 108, based on input from control (DEQ/DRC) 110. In one exemplary embodiment, the output from the DEQ 112 includes the associated audio bands and control data for dynamic range controllers (DRC) 114, 116 and 118, which can reduce an input audio signal frequency or frequency band to prevent distortion at the associated frequency or frequency band. The processed output is then added by adder 120, and master DRC 122 then processes the composite signal.

In operation, system 100 allows a system to be analyzed to generate THD data and then processes input audio data for the system to prevent distortion, by processing the input audio signal to limit the signal at frequencies or frequency bands where distortion may occur.

Figure 2:
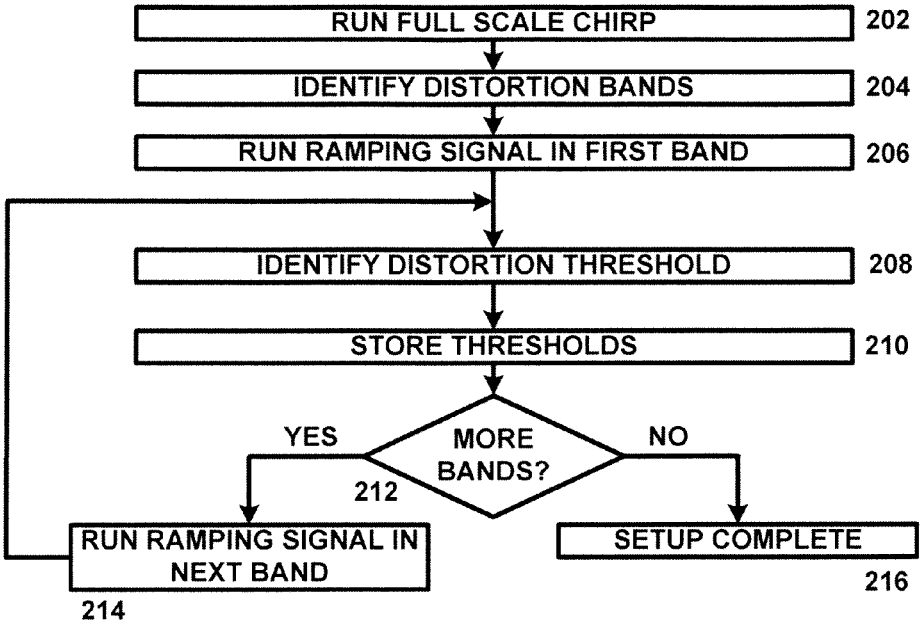
FIG. 2 is a diagram of an algorithm for determining distortion thresholds in accordance with an exemplary embodiment of the present disclosure.

FIG. 2 is a diagram of an algorithm 200 for determining distortion thresholds in accordance with an exemplary embodiment of the present disclosure. Algorithm 200 can be implemented as software operating on a processing platform, as logic implemented in silicon, using an application-specific integrated circuit or in other suitable embodiments.

Algorithm 200 begins at 202, where a full-scale chirp is generated. In one exemplary embodiment, the full-scale chirp can be generated in response to a control signal from a processor or other suitable controllers, and can increase from a low frequency to a high frequency, can decrease from a high frequency to a low frequency, or can be performed in other suitable manners. The algorithm then proceeds to 204, such as after a signal is generated that indicates that the full-scale chirp has been completed and results have been measured.

At 204, distortion bands are identified. In one exemplary embodiment, the output harmonic distortion response of the system to the full scale chirp can be analyzed as a function of frequencies to identify frequencies where the distortion exceeds a predetermined threshold. In this exemplary embodiment, the output signal can be transformed to a frequency domain, such as by discrete Fourier transform or in other suitable manners. The distortion bands can be determined based upon predetermined bandwidths within the frequency domain (e.g. 1 kHz bands), can be assigned based on a continuous region of frequency components where each frequency component exceeds the threshold, or can be determined in other suitable manners. After the distortion band parameters have been stored in a suitable data memory, such as a volatile or non-volatile silicon memory device, the algorithm then proceeds to 206.

At 206, a ramping signal is generated and applied to the system under test in the first distortion band. In one exemplary embodiment, the ramping signal can be at a single frequency or a range of frequencies, and the signal can be increased from a minimum value until a threshold distortion level is measured at a system output. Other suitable ramping signals can also or alternatively be used. The algorithm then proceeds to 208.

At 208, a distortion threshold level is identified for the frequency band under test. In one exemplary embodiment, the distortion threshold level can be identified by monitoring a filtered system output, power consumption, or other suitable parameters. The algorithm then proceeds to 210.

At 210, the distortion threshold is stored for use in processing a signal. In one exemplary embodiment, the distortion threshold can be stored in a data memory device for use by a system controller to process an audio signal. The algorithm then proceeds to 212.

At 212, it is determined whether there are additional frequencies or frequency bands that need to be tested. If it is determined that there are additional frequency bands, the algorithm proceeds to 214, where a ramping signal is generated and applied to the system in the frequency or frequency band under test. The algorithm then returns to 208. If it is determined at 212 that there are no further distortion levels to be tested, the algorithm proceeds to 216, and system setup is completed.

In operation, algorithm 200 is used to analyze an audio system to determine frequency bands where distortion levels are present, and to determine the input signal levels at which distortion exceeds a threshold. Algorithm 200 can be used to test an audio system to develop a set of input signal levels for the associated distortion frequency bands, for use in processing an input audio signal.

Figure 3:
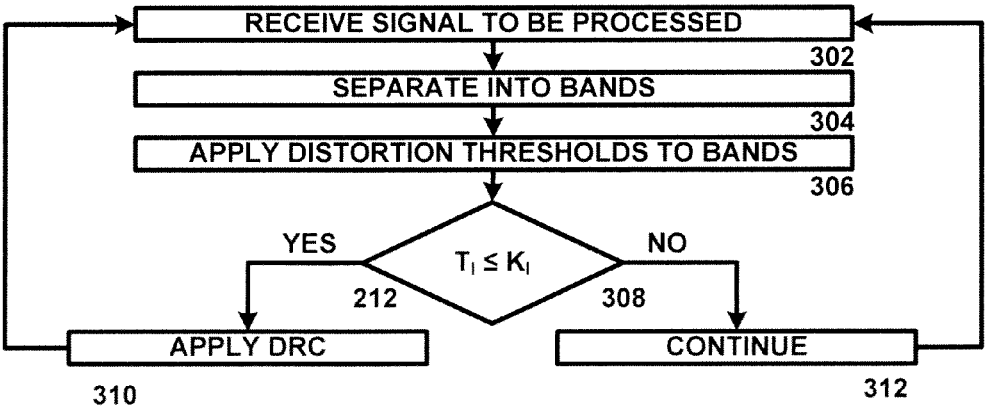
FIG. 3 is a diagram of an algorithm for applying distortion thresholds to an audio signal in accordance with an exemplary embodiment of the present disclosure.

FIG. 3 is a diagram of an algorithm 300 for applying distortion thresholds to an audio signal in accordance with an exemplary embodiment of the present disclosure. Algorithm 300 can be implemented as software operating on a processing platform, as logic implemented in silicon, using an application-specific integrated circuit or in other suitable embodiments.

Algorithm 300 begins at 302, where a signal is received for processing. In one exemplary embodiment, the signal can be received at an audio device and can be transformed to a frequency domain, such as to determine the frequency components of the signal. The algorithm then proceeds to 304.

At 304, the signal is separated into frequency bands. In one exemplary embodiment, the signal can be separated into low, middle and high frequency bands, can be separated into frequency bands as a function of frequency components in the signal that correspond to frequency bands where distortion has been detected, or in other suitable manners. In another exemplary embodiment, a data memory can be accessed and a plurality of frequencies or frequency bands at which distortion has been observed can be retrieved, in addition to associated amplitude data for each frequency or frequency band that is associated with an amplitude at which distortion is initiated, such as an amplitude that is slightly lower than the distortion onset level (such as one to ten percent or other suitable empirically determined levels). The algorithm then proceeds to 306.

At 306, the distortion threshold levels are applied to the frequency bands. In one exemplary embodiment, the input signal magnitude can be determined for each corresponding frequency band at which the system distortion needs to be controlled. The algorithm then proceeds to 308.

At 308, it is determined whether the input signal for a given frequency band is equal to or greater than the corresponding threshold level for that frequency band. If it is determined that the input signal for a given frequency band is equal to or greater than the threshold, the algorithm proceeds to 310, where dynamic range compression or other suitable magnitude limiting processing is applied to the signal at each frequency band where the signal is equal to or greater than the threshold. The algorithm then returns to 302. If it is determined that the input signal for a given frequency band is not equal to or greater than the threshold, the algorithm proceeds to 312, where the process continues for the next signal sample.

In operation, algorithm 300 is used to process an input signal in accordance with previously-measured distortion thresholds for the system to which the signal is being applied, in order to reduce the signal magnitude for frequency bands where distortion would otherwise be generated. Algorithm 300 thus prevents the system from being exposed to signals that would generate distortion.

The general basic algorithm implemented in system 100 addresses rattling, rub and buzz distortion, electrical saturation control, bass boost, loudness and equalization. The control algorithm can be derived from a tuning procedure that is flexible enough to accommodate general waveform shaping, and which uses a combination of dynamic spectral equalization and multiband dynamic range compensation followed by a master look-ahead dynamic range compensation that provides loudness boost and electrical saturation limiting functionality.

One exemplary embodiment of the present disclosure provides a method for dynamic range compensation of distortion. The method includes measuring the distortion profile of the device under test and then activating the dynamic band limiter as outlined below.

First, a full-scale chirp is generated to identify distortion bands (B1, B2 . . . BN). A ramping band-limited signal is then generated within each band, so as to probe each distortion band ($B_1$, $B_2$ . . . $B_N$). Each band is then decomposed into sub-bands, such as B1 into ($B_{11}$, $B_{12}$ . . . $B_{1N}$), B2 into ($B_{21}$, $B_{22}$ . . . $B_{2N}$) and so forth. The distortion threshold (RMS) of the band limited probe tone is based on pre-specified distortion thresholds. The resulting output includes a set of digital RMS levels $U(B_{IJ})$.

Given an input x(n), the input is then split into multiple bands corresponding to ($B_1$, $B_2$ . . . $B_N$). The band-limited RMS $X(B_{IJ})$ is then measured. One exemplary criterion for determining whether rattling/distortion buster should be applied is developed as follows. For each band $B_I$ define $T_I$, where:

$$T_I = \sum_{J=1}^{M} \frac{X(B_{IJ})}{U(B_{IJ})}$$

For each band $B_I$, let the pre-specified threshold be $K_I$. The typical value of $K_I$=1. The criterion then is:

$T_I \leq K_I$: No distortion $T_I > K_I$: Distortion

The dynamic range compensation is activated at the o/p of each band, so as to limit the amplitude so that $T_I$ is less than $K_I$.

Some of the finer details like the bandwidth of band-pass and the dynamic range compensation parameters may need to be empirically determined. Other computationally friendly metrics for $T_I$ include:

$$T_I = \Sigma_{J=1}^{M}(X(B_{IJ}) - U(B_{IJ})),$$

$$T_I = \Sigma_{J=1}^{M}(X(B_{IJ}) > U(B_{IJ})), \text{ and}$$

$$T_I = \Sigma_{J=1}^{M}(\log_2 X(B_{IJ}) - \log_2 U(B_{IJ})).$$

The multiband filters can be designed such that they weight the input signal by $1/U(B_{IJ})$ thus enabling the decision to activate DRC, based on direct RMS measurements. The RMS measurements can be performed on a frame by frame basis, or can be another suitable form of "short term" measurement.

In another exemplary embodiment, the signal can be processed similar to processing for equal loudness curves. In this exemplary embodiment, a set of equal THD curves can be obtained for a device, such as curves having an X-axis frequency and a Y axis amplitude corresponding to a given THD. The set of such contours is referred to as equal THD curves and can be modeled as a transfer function. The equal THD transfer function is used to control a dynamic equalizer or multi-band DRC.

The disclosed systems and methods can be used to control rattling, such as where different points in the enclosure have a different vibrational response to an input signal. When the points are places of contact, there is inertial mismatch. One extreme type of distortion is rub and buzz distortion. Another extreme type of distortion can be caused by a loose screw or loose particle. The present disclosure is used to prevent excitation of the rattling point. The vibrating point with inertial mismatch can be referred to as a "hot spot." Each hot spot has a THD curve that shifts with respect to amplitude. Each hotspot has an amplitude v(f) where it starts to rattle. In this exemplary embodiment, v(f) can be full scale at non-hotspots, and can be significantly low at hotspots. Within a rattling bandwidth, the voltage spectrum can be normalized, summed and checked to determine if it is less than one:

$$V = v(f1) + v(f2) + \ldots v(fN) < 1.0$$

If the magnitude is greater than one, attenuation is applied in that band.

In another exemplary embodiment, for multi-band DRC, the rattling bands are identified by probing with a full-scale chirp test tone. The multi-bands can represent rattling and non-rattling bands. The DRC threshold of rattling bands can be set to the voltage threshold as measured by band-limited white noise.

Figure 4:
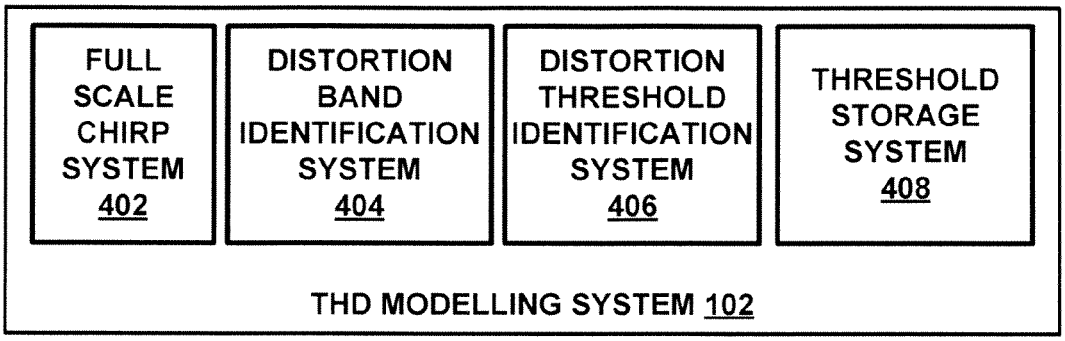
FIG. 4 is a diagram of a system for determining distortion thresholds for an audio system in accordance with an exemplary embodiment of the present disclosure.

FIG. 4 is a diagram of a system 400 for determining distortion thresholds for an audio system in accordance with an exemplary embodiment of the present disclosure. System 400 can be implemented in hardware or a suitable combination of hardware and software, and can be one or more software systems operating on one or more processing platforms.

System 400 includes THD modeling system 102 and full scale chirp system 402, distortion band identification system 404, distortion threshold identification system 406 and threshold storage system 408. Full scale chirp system 402 generates a full-scale chirp, such as in response to a control signal from a processor or other suitable controllers. The full-scale chirp can include a signal that increases from a low frequency to a high frequency, a signal that decreases from a high frequency to a low frequency, a broadband frequency signal, or other suitable signals. In one exemplary embodiment, a controllable oscillator or other suitable components with associated control circuits or systems can be used. In addition, the amplitude of the full-scale chirp can also be varied, such as by running a plurality of full scale chirps at different amplitudes, by altering the amplitude of each frequency of the full-scale chirp signal from a low value to a high value, or in other suitable manners. Likewise, full scale chirp system 402 can include a plurality of signal generators that generate signals in sequence, in parallel, or in other suitable manners, such as signals having different frequencies, signals having different amplitudes, or other suitable signals.

Distortion band identification system 404 receives an output audio signal that includes the output harmonic distortion response of the system to the full scale chirp or other suitable signals, and analyzes the output audio signal as a function of frequencies or frequency bands to identify frequencies or frequency bands where distortion occurs or exceeds a predetermined threshold. In one exemplary embodiment, the output audio signal can be transformed to a frequency domain, such as by using a discrete Fourier transform analyzer system or circuit or in other suitable manners, and the frequencies or frequency bands and amplitude levels at which distortion occurs can be determined based upon predetermined bandwidths within the frequency domain (e.g. 1 kHz bands), can be assigned based on a continuous region of frequency components where each frequency component exceeds the threshold, or can be determined in other suitable manners.

Distortion threshold identification system 406 can generate a ramp signal or other suitable signals that can be applied to the system under test at each frequency or frequency band at which distortion has been detected. In one exemplary embodiment, the ramp signal can be at a single frequency or a range of frequencies, the signal can be increased from a minimum amplitude value until a threshold distortion level is measured at a system output, such as by using a Fourier transform analyzer system or circuit or in other suitable manners, or other suitable signals can also or alternatively be used.

Threshold storage system 408 stores distortion frequencies, frequency bands and associated levels for use in processing an input audio signal, so as to prevent distortion from occurring. In one exemplary embodiment, the distortion data can be stored for a predetermined device, such as in a data storage mechanism of the device, random access memory, a magnetic storage medium or in other suitable locations.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for controlling distortion comprising:

a total harmonic distortion (THD) modeling system configured to identify, based on applying a test signal to a system under test, one or more frequencies at which distortion is present in the system under test and associated amplitudes for each of the frequencies; and a signal processing system configured to receive the one or more frequencies and associated amplitudes and to process an input audio signal to prevent distortion;

wherein the THD modeling system further comprises a full scale chirp system configured to generate the test signal having a plurality of frequency components from a minimum frequency value to maximum frequency value and to transmit the test signal to a system under test coupled thereto.

2. The system of claim 1 wherein the THD modeling system further comprises a distortion band identification system configured to receive an output from the system under test and to generate data that identifies one or more frequencies or frequency bands at which distortion is present.

3. The system for controlling distortion of claim 1, wherein the system is configured to:

receive an audio input signal;

determine, using the THD modeling system, whether frequency components are present in the audio input signal at each of the one or more frequencies at which distortion occurs;

determine, using the THD modeling system, whether the magnitude of the audio input signal for each of the frequencies at which distortion occurs exceeds an amplitude level associated with an onset of distortion for that frequency band; and limit, using the signal processing system, the amplitude of the audio input signal at each of the corresponding frequencies at which distortion can occur.

4. The system of claim 3 wherein the amplitude of the audio input signal is further limited by performing dynamic range control on the audio input signal at the one or more frequencies at which distortion occurs.

5. The system of claim 3 further configured to apply a ramp signal to the system under test at each of the one or more frequencies at which distortion occurs.

6. The system of claim 3 further configured to store amplitude data associated with an onset of distortion for each of the one or more frequencies at which distortion occurs.

7. The system of claim 3 wherein the amplitude of the audio input signal is further limited by performing dynamic range control on the audio input signal at the one or more frequencies at which distortion occurs.

8. A system for controlling distortion comprising:

a total harmonic distortion (THD) modeling system configured to identify, based on applying a first test signal to a system under test, one or more frequency bands at which distortion is present in the system under test and determine, based on applying a second test signal comprising a ramping band-limited signal to the identified frequency bands, associated amplitudes for each of the frequencies at which distortion onset occurs; and a signal processing system configured to receive the identified frequency bands and associated amplitudes and to process an audio input signal to prevent distortion;

wherein the THD modeling system further comprises a distortion threshold identification system configured to generate the first and the second test signals and to generate distortion onset data for each of the identified frequency bands.

9. The system of claim 8 wherein the THD modeling system further comprises a full scale chirp system configured to generate the first test signal, wherein the first test signal comprises a chirp signal having a plurality of frequency components from a minimum frequency value to maximum frequency value and to transmit the first test signal to the system under test.

10. The system of claim 8 wherein the THD modeling system further comprises a distortion band identification system configured to receive an output from the system under test and to generate data that identifies one or more frequencies or frequency bands at which distortion is present.

11. The system for controlling distortion of claim 8, wherein the system is configured to:

receive the audio input signal;

determine, using the THD modeling system, whether frequency components are present in the audio input signal at each of the one or more identified frequency bands at which distortion occurs;

determine, using the THD modeling system, whether the magnitude of the audio input signal for each of the identified frequency bands at which distortion occurs exceeds an amplitude level associated with an onset of distortion for that frequency band; and limit, using the signal processing system, the amplitude of the audio input signal at each of the corresponding frequency bands at which distortion can occur.

12. The system of claim 11 further configured to apply a chirp signal to the system under test.

13. The system of claim 11 further configured to apply a ramp signal to the system under test at each of the identified frequency bands at which distortion occurs.

14. A method for processing audio comprising:

retrieving data identifying a plurality of frequencies and associated magnitude data for each of the plurality of frequencies from an electronic data memory at an audio device;

filtering an audio input signal to isolate each of the plurality of frequencies; and adjusting a magnitude of the audio input signal for each of the plurality of frequencies as a function of the associated magnitude data for each of the plurality of frequencies;

wherein filtering the audio input signal to isolate each of the plurality of frequencies comprises:

weighting the input signal by $1/U(B_{IJ})$, wherein:

$U(B_{IJ})$ is an array of digital root mean square (RMS) levels;

I is a frequency band identifier identifying frequency bands of the audio input signal; and J is a frequency sub-band identifier identifying frequency sub-bands of each frequency band of the audio input signal.

15. The method of claim 14 wherein the plurality of frequencies comprises a plurality of frequency ranges.

16. The method of claim 14 wherein adjusting the magnitude of the audio input signal for each of the plurality of frequencies as the function of the associated magnitude data for each of the plurality of frequencies comprises performing dynamic range control.

17. The method of claim 14 wherein adjusting the magnitude of the audio input signal for each of the plurality of frequencies as the function of the associated magnitude data for each of the plurality of frequencies comprises adjusting the magnitude of the audio input signal for each of the plurality of frequencies in the frequency domain.

18. The method of claim 14 wherein adjusting the magnitude of the audio input signal for each of the plurality of frequencies as the function of the associated magnitude data for each of the plurality of frequencies comprises activating dynamic range control as a function of direct RMS measurements.

* * * * *